US006047829A

United States Patent [19]

Johnstone et al.

[11] Patent Number: 6,047,829

[45] Date of Patent: Apr. 11, 2000

[54] UNIT DOSE PACKAGING SYSTEM (UDPS) HAVING A CHILD RESISTANT LOCKING FEATURE

[75] Inventors: Scott Bowen Johnstone, Midlothian; Brad Allen Jones, Chesterfield; Mark Mellon; William Roger Rigby, both of Midlothian, all of Va.

[73] Assignee: Westvaco Corporation, New York, N.Y.

[21] Appl. No.: 09/157,292

[22] Filed: Sep. 18, 1998

[51] Int. Cl.[7] ..... B65D 83/04

[52] U.S. Cl. ..... 206/531; 206/1.5; 206/539; 229/125.125

[58] Field of Search ..... 206/1.5, 528, 530, 206/531–539, 807; 229/125.125, 132

[56] References Cited

U.S. PATENT DOCUMENTS

| | | | |
|---|---|---|---|
| Re. 35,445 | 2/1997 | Pora | 206/532 |
| 3,215,332 | 11/1965 | Bess | 229/125.125 |
| 3,888,350 | 6/1975 | Horvath . | |
| 3,987,891 | 10/1976 | Horvath | 206/1.5 |
| 4,007,828 | 2/1977 | Mayled . | |
| 4,113,098 | 9/1978 | Howard . | |
| 4,126,224 | 11/1978 | Laauwe et al. . | |
| 4,192,422 | 3/1980 | Kotyuk . | |
| 4,364,488 | 12/1982 | Anjou . | |
| 4,401,210 | 8/1983 | Anjou . | |
| 4,817,819 | 4/1989 | Kelly . | |
| 4,940,016 | 7/1990 | Heath | 229/132 |
| 5,150,793 | 9/1992 | Tannenbaum | 206/531 |
| 5,244,091 | 9/1993 | Tannenbaum . | |
| 5,275,291 | 1/1994 | Sledge . | |
| 5,402,888 | 4/1995 | Marie . | |
| 5,582,344 | 12/1996 | Lawson et al. | 229/132 |
| 5,732,822 | 3/1998 | Mitsuyama . | |

FOREIGN PATENT DOCUMENTS

WO97/38919 10/1997 WIPO .

*Primary Examiner*—Paul T. Sewell
*Assistant Examiner*—Luan K. Bui
*Attorney, Agent, or Firm*—J. R. McDaniel; R. L. Schmalz

[57] ABSTRACT

This invention relates to a two piece paperboard package that houses a unit dose product on an internal slide card within an outer paperboard shell. This package may have one or more internal or external lock(s) that prevent the slide card from being pulled out without triggering some type of lock release mechanism. This package is focused around providing a child resistant, senior-friendly unit dose package that can be opened and closed numerous times and then finally disposed of.

6 Claims, 11 Drawing Sheets

UNIT DOSE PACKAGING SYSTEM (UDPS) HAVING A CHILD RESISTANT LOCKING FEATURE

BACKGROUND OF THE INVENTION

1. Field of the Invention

This invention relates to a two piece paperboard package that houses a unit dose product on an internal slide card within an outer paperboard shell. This package may have one or more internal or external lock(s) that prevent the slide card from being pulled out without triggering some type of lock release mechanism. This package is focused around providing a child resistant, senior-friendly unit dose package that can be opened and closed numerous times and then finally disposed of.

2. Description of the Related Art

It is known in the tablet dispenser art to employ a container which comprises the housing having an opening in its top wall and a drawer which slidably sits in the housing. Exemplary of such prior art is U.S. Pat. No. 5,275,291 ('291) to L. C. Sledge, entitled "Tablet Dispenser". While the '291 reference employs a locking feature, the locking feature for the package relies on the lock forming an upward button which, when the drawer is closed, extends up through the opening into the wall of the housing. Also, it must be pointed out that the button may be pushed when it is in the relief zone. The relief zone is used to stop the slide drawer from being pulled out. By having this option, the user may choose to disable the child resistant feature of the '291 reference prematurely by pushing the button to release the drawer from the outer shell. Therefore, a more advantageous system, then, would be presented if such a button assembly could be eliminated.

It is apparent from the above that there exists a need in the art for a unit dose packaging system which is able to dispense medications and which at least equals the child resistant characteristics of the known dispensers, but which at the same time eliminates the use of the button release mechanism.

It is a purpose of this invention to fulfill this and other needs in the art in a manner more apparent to the skilled artisan once given the following disclosure.

SUMMARY OF THE INVENTION

Generally speaking, this invention fulfills these needs by providing a unit dose paperboard package having a locking feature, comprising an outer paperboard sleeve and an inner paperboard slide card lockably retained within the outer sleeve, such that the outer sleeve includes a plurality of side panels operatively connected to each other such that one of the plurality of side panels includes an inner slide card retaining means and a first inner slide card releasing means and another of the plurality of the side panels includes a second inner slide card releasing means and the inner slide card includes a plurality of unit dose dispensing means and an inner slide card retaining/releasing means located substantially adjacent to the unit dose dispensing means.

In certain preferred embodiments, the inner slide card retaining means are extension panels. Also, the first inner card releasing means includes a cut-out area and a node on one of the side panels. Also, the second inner slide card releasing means includes a release button. Finally, the inner slide card retaining/releasing means includes panel extensions.

In another further preferred embodiment, the outer sleeve of the package provides additional protection for the inner slide card, which holds the unit dose product being used. The inner slide portion of the package has a stop feature that connects with a catch feature on the outer sleeve to prevent the user from pulling the inner slide completely away from the outer sleeve. Furthermore, the package is focused around providing a child-resistant, senior-friendly unit dose package that can be opened and closed numerous times and then finally disposed of.

The preferred unit dose package, according to this invention, offers the following advantages: lightness in weight; resistance to tampering; child resistance; senior friendliness; excellent durability; ease of assembly; unit dose protection and excellent economy. In fact, in many of the preferred embodiments, these factors of lightness in weight, tamper resistance, child resistance, senior friendliness, durability, ease of assembly, unit dose protection and economy are optimized to the extent that is considerably higher than heretofore achieved in prior, known unit dose packages.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Paperboard is used as a substrate for outer sleeve blank 2 (FIG. 1) and inner slide card blank 100 (FIG. 6) and is, typically, constructed from a sheet of bleached sulphate, solid unbleached sulphate (SUS) or clay-coated newsback (CCNB). Definitively, the term paperboard describes paper within the thickness range of 0.008 to 0.028 inches. The invention is relevant to the full scope of such a range, as applied to packaging and beyond.

When used for unit dose packaging stock, the paperboard is usually clay coated on at least one side surface and occasionally on both sides. The paperboard trade characterizes a paperboard web or sheet that has been clay coated on one side as C1S and C2S for a web coated on both sides. Compositionally, the paperboard coating is a fluidized blend of minerals such as coating clay, calcium carbonate and/or titanium dioxide with starch or adhesive which is smoothly applied to the traveling surface. Successive densification and polishing by calendaring finishes the mineral coated surface to a high degree of smoothness and superior graphic print surface.

Figure 1:
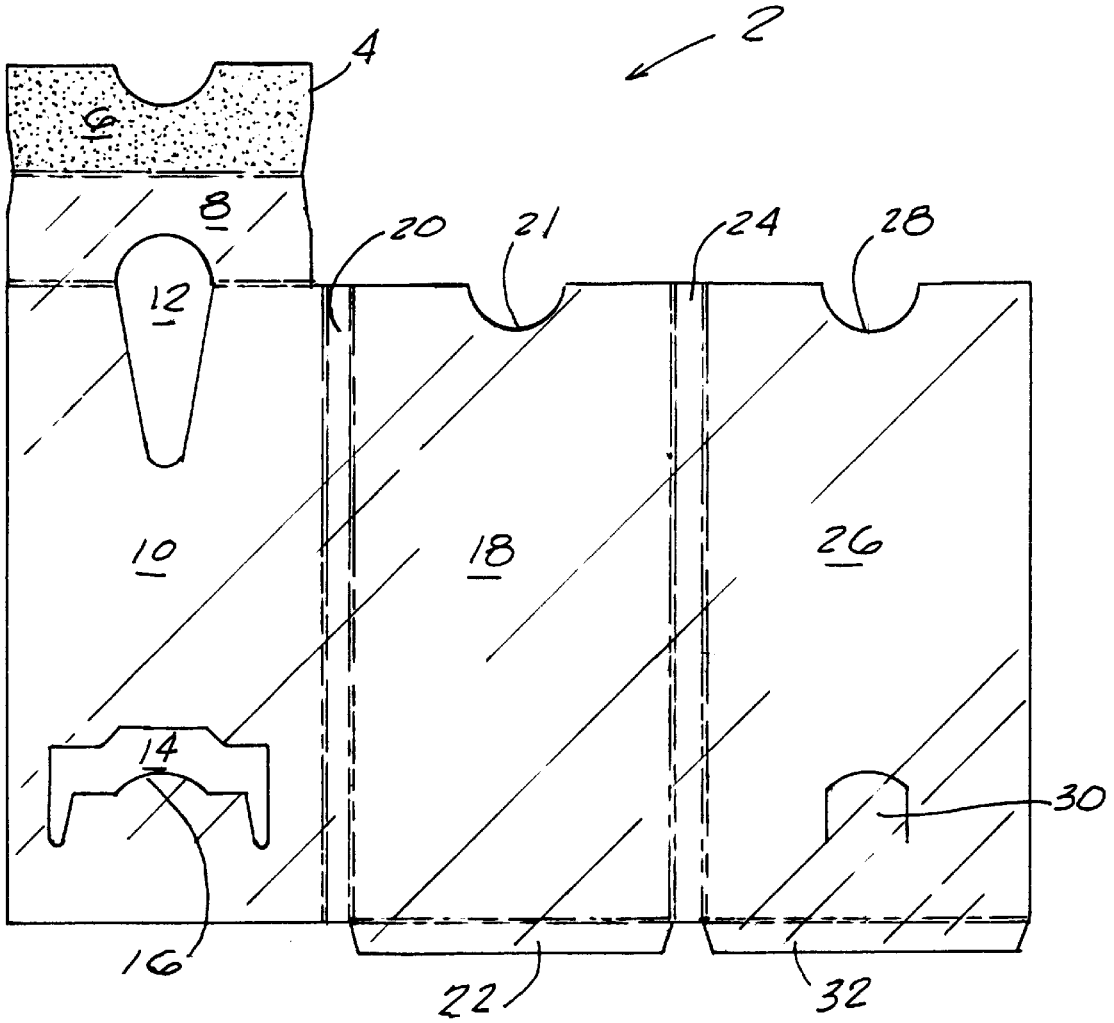
FIG. 1 is a plan view of an outer sleeve blank for a unit dose paperboard package with a child resistent lock, according to the present invention.

With reference first to FIG. 1, there is illustrated an advantageous environment for use of the concepts of this invention. In particular, outer sleeve paperboard blank 2 is illustrated. Blank 2 includes, in part, extension panels 4 and 8, conventional glue area 6, side panels 10, 18 and 26, cut away areas 12 and 14, node 16, side panels 20 and 24, cut outs 21 and 28, end flaps 22 and 32 and release button 30.

Cut away areas 12 and 14 and cut outs 21 and 28 are constructed by suitable cutting techniques. Release button 30 is cut within panel 26 by conventional techniques.

Figure 2:
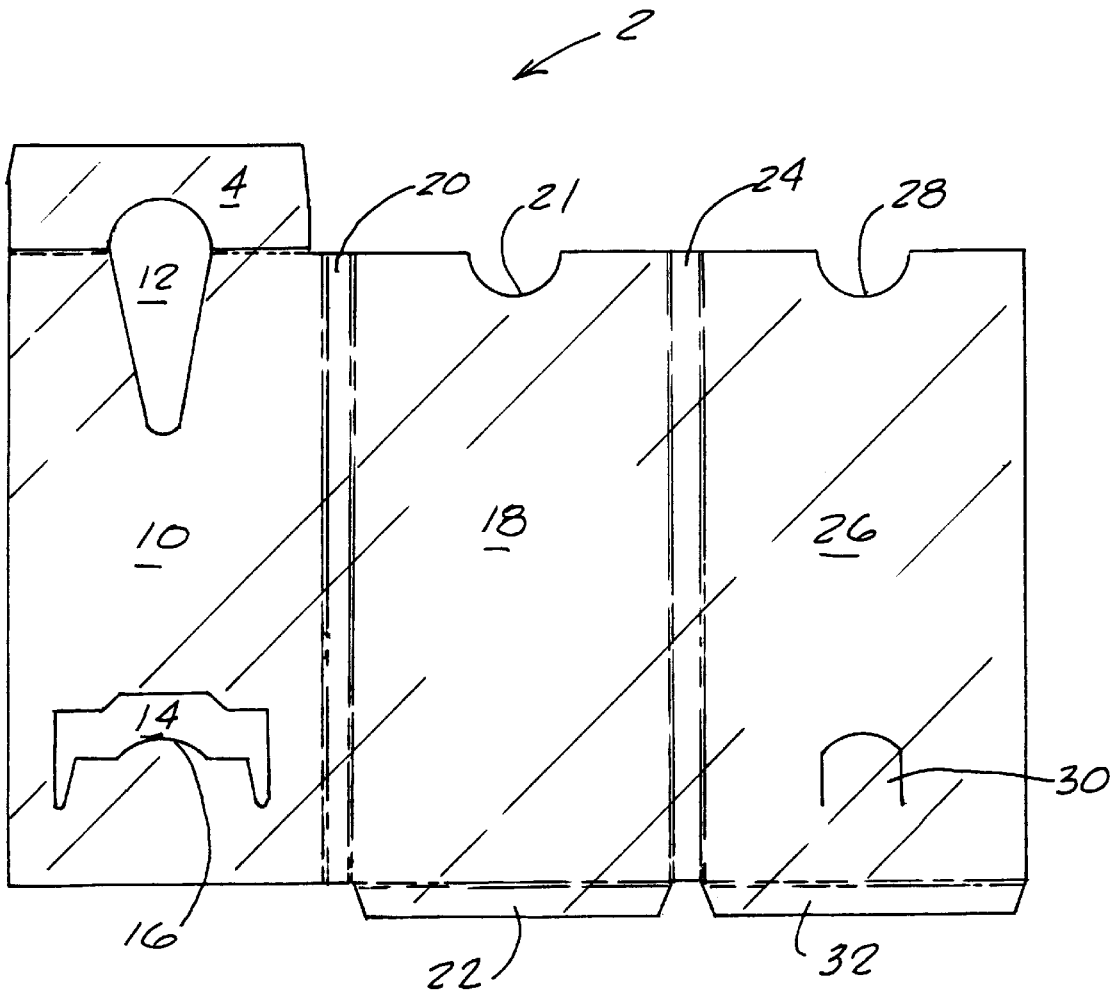
FIG. 2 is a plan view of the outer sleeve blank of FIG. 1 with one of the panels folded, according to the present invention.

As shown in FIG. 2, extension 4 is folded over and adhesively attached to panel extension 8 by conventional techniques.

Figure 3:
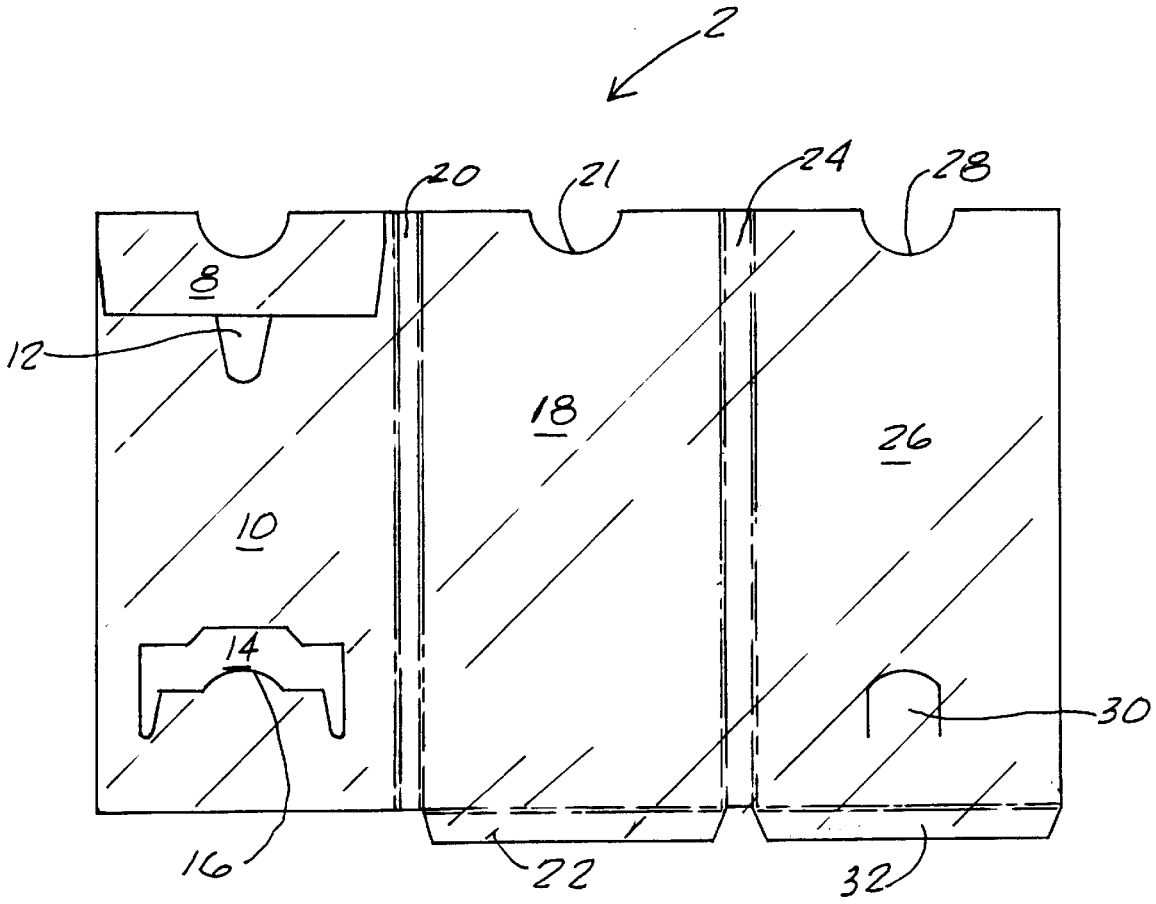
FIG. 3 is a plan view of the outer sleeve blank of FIG. 2 with another panel folded, according to the present invention.

With respect to FIG. 3, extension panel 8 is folded over side panel 10.

Figure 4:
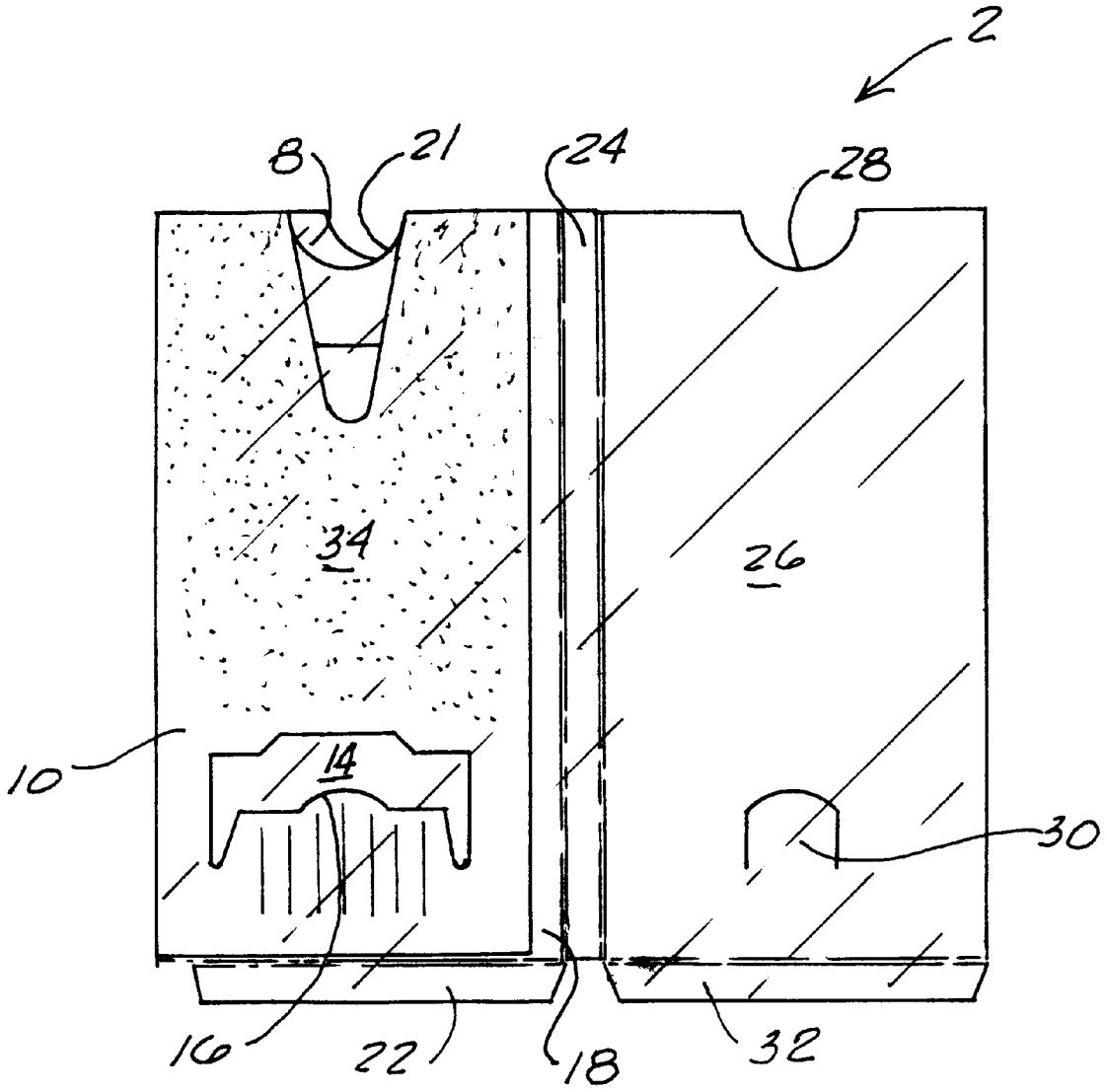
FIG. 4 is a plan view of the outer sleeve blank of FIG. 3 with another panel folded, according to the present invention.

As shown in FIG. 4, side panel 10 is folded over side panel 18. Also, as can be seen in FIG. 4, side panel 10 includes conventionally applied adhesive area 34.

Figure 5:
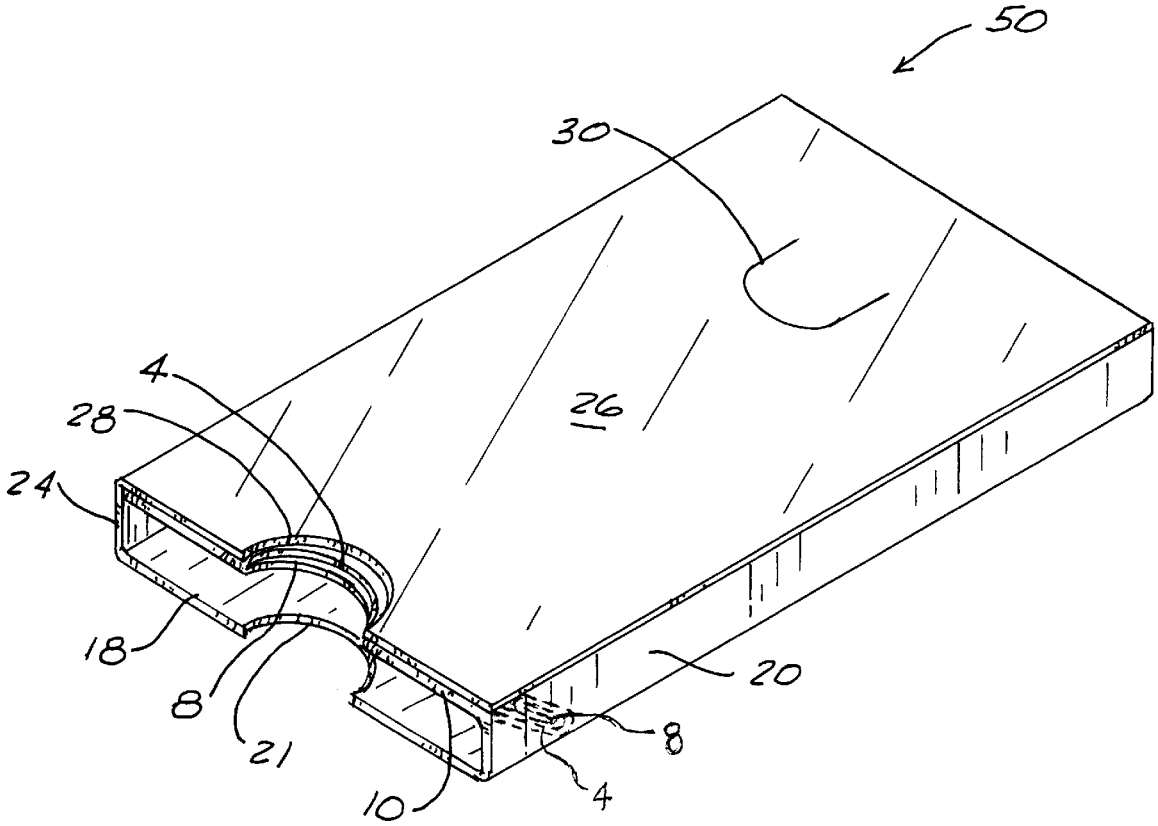
FIG. 5 is an isometric view of a completely constructed outer sleeve for the unit dose package, according to the present invention.

As shown in FIG. 5, there is illustrated a completely constructed outer sleeve 50 which includes release button 30 and panel extension 4. In this manner, panel extension 4 acts as a stopping device that prevents inner slide card 100 (FIG. 9) from being pulled completely out of outer sleeve 50 (FIG. 10). En particular, as shown in FIG. 5, folded panels 4 and 8 extend down towards side panel 18 to create the stopping device.

Figure 6:
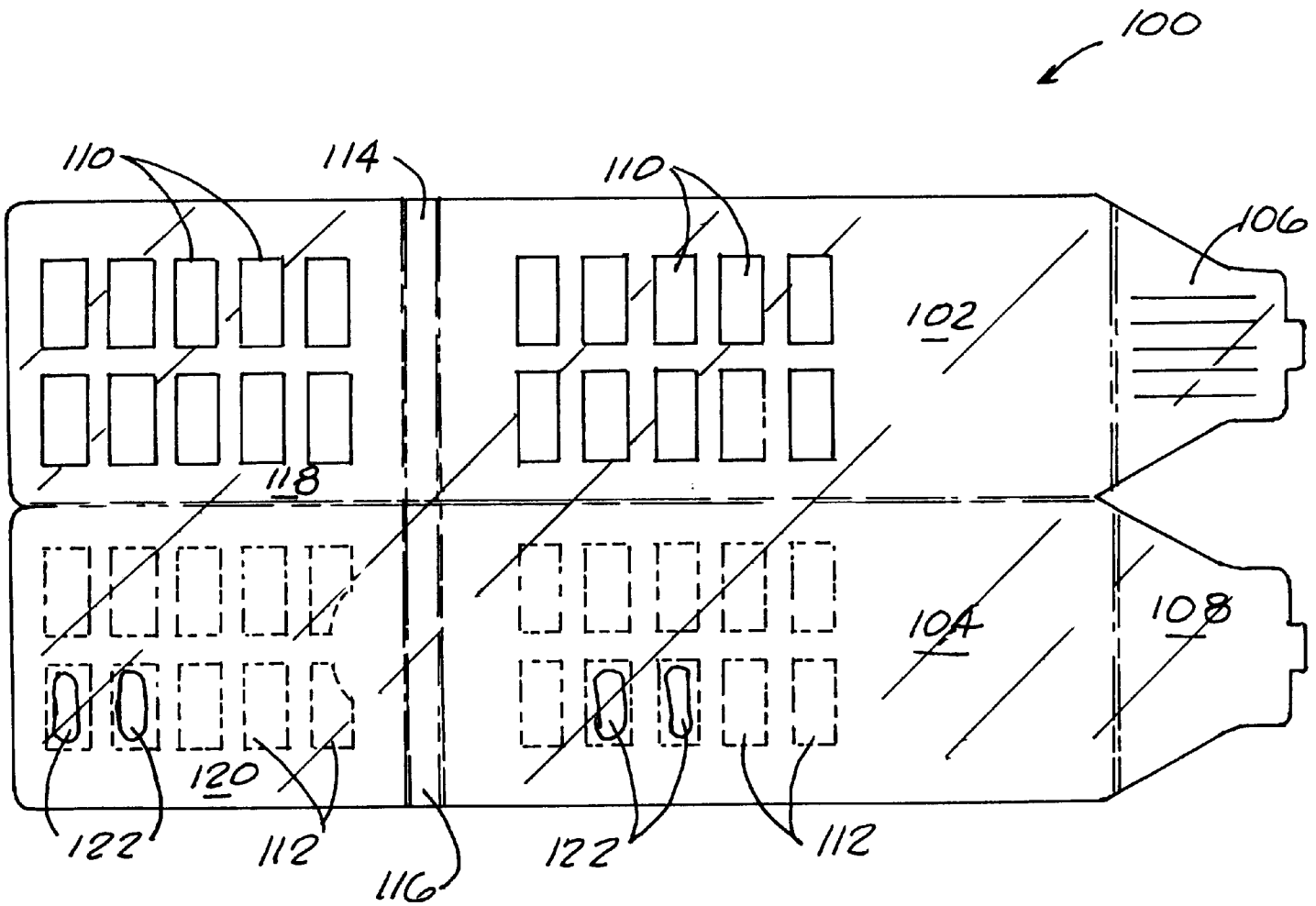
FIG. 6 is a plan view of an inner slide card blank for the unit dose package, according to the present invention.

With respect to FIG. 6, there is illustrated inner slide card paperboard blank 100. Blank 100 includes, in part, side panels 102 and 104, side panel extensions 106 and 108, conventional unit dose packaging holes 110, conventional unit dose packaging perforated areas 112, panels 114 and 116, side panels 118 and 120 and conventional unit doses 122. Also, it is to be understood that side panels 102, 104, 118 and 120, extensions 106 and 108, and panels 114 and 116 are constructed of the same material as side panel 10 (FIG. 1).

Figure 7:
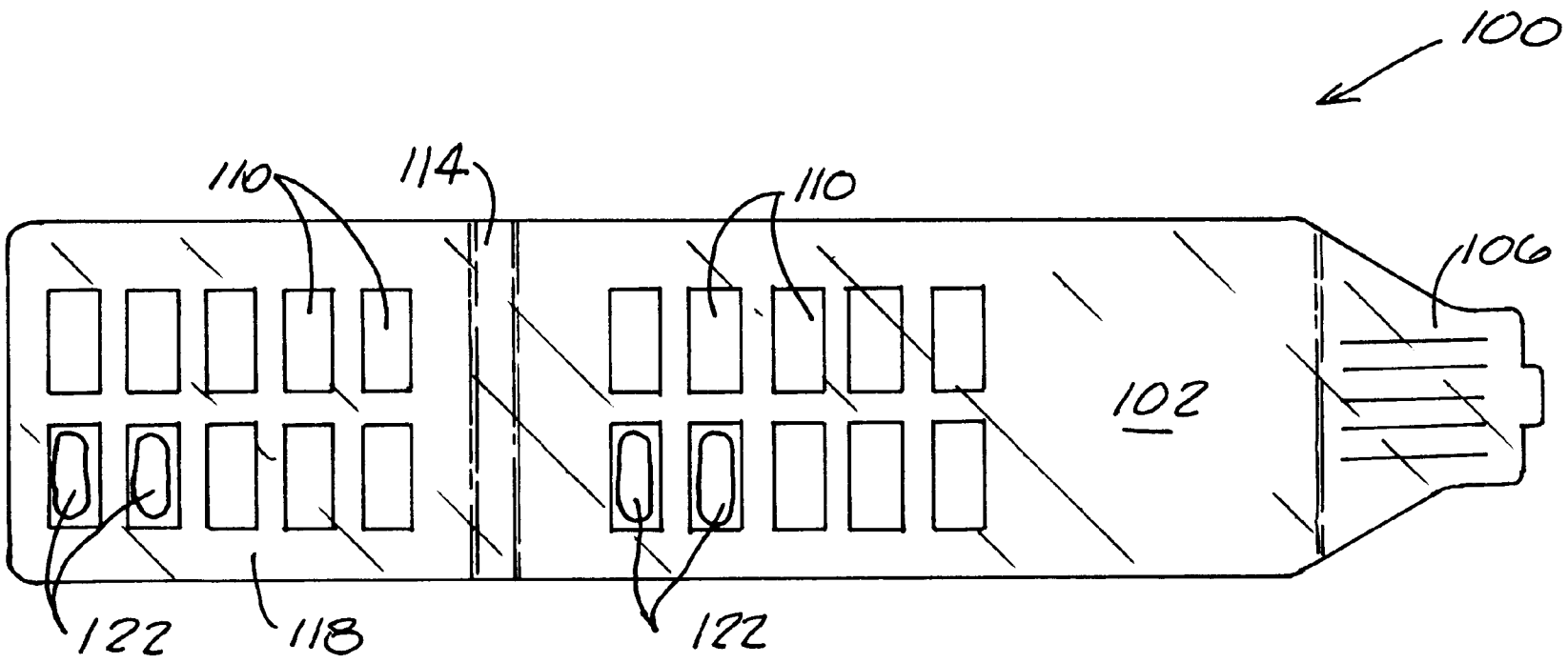
FIG. 7 is a plan view of the blank for the inner slide card of FIG. 6 with one of the panels folded, according to the present invention.

In FIG. 7, panels 102 and 118 have been folded over panels 104 and 120, respectively, such that unit doses 122 extend through holes 110 in panels 102 and 118 and unit doses 122 are trapped in holes 110.

Figure 8:
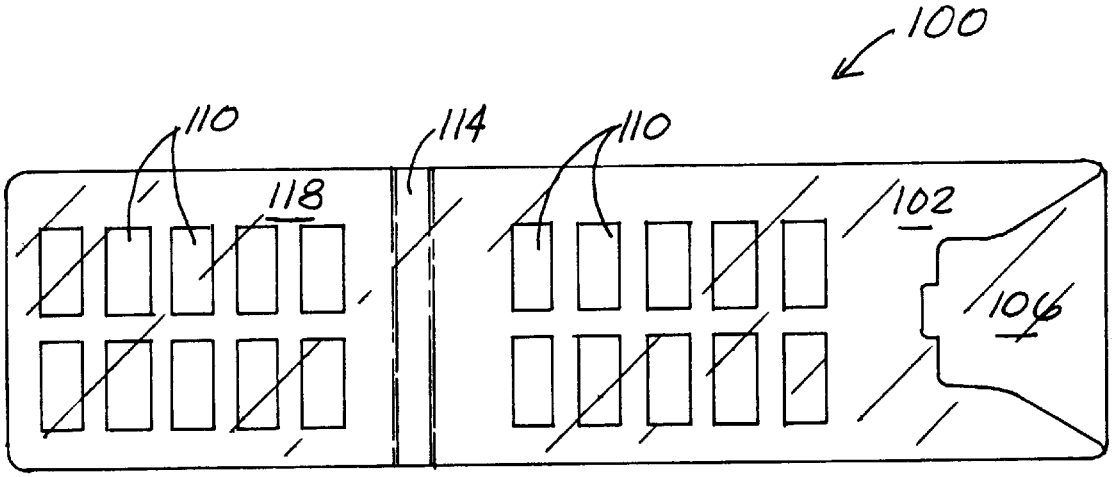
FIG. 8 is a plan view of the inner slide card blank of FIG. 7 with another panel folded, according to the present invention.

As shown in FIG. 8, extension panel 106 is folded over side panel 102.

Figure 9:
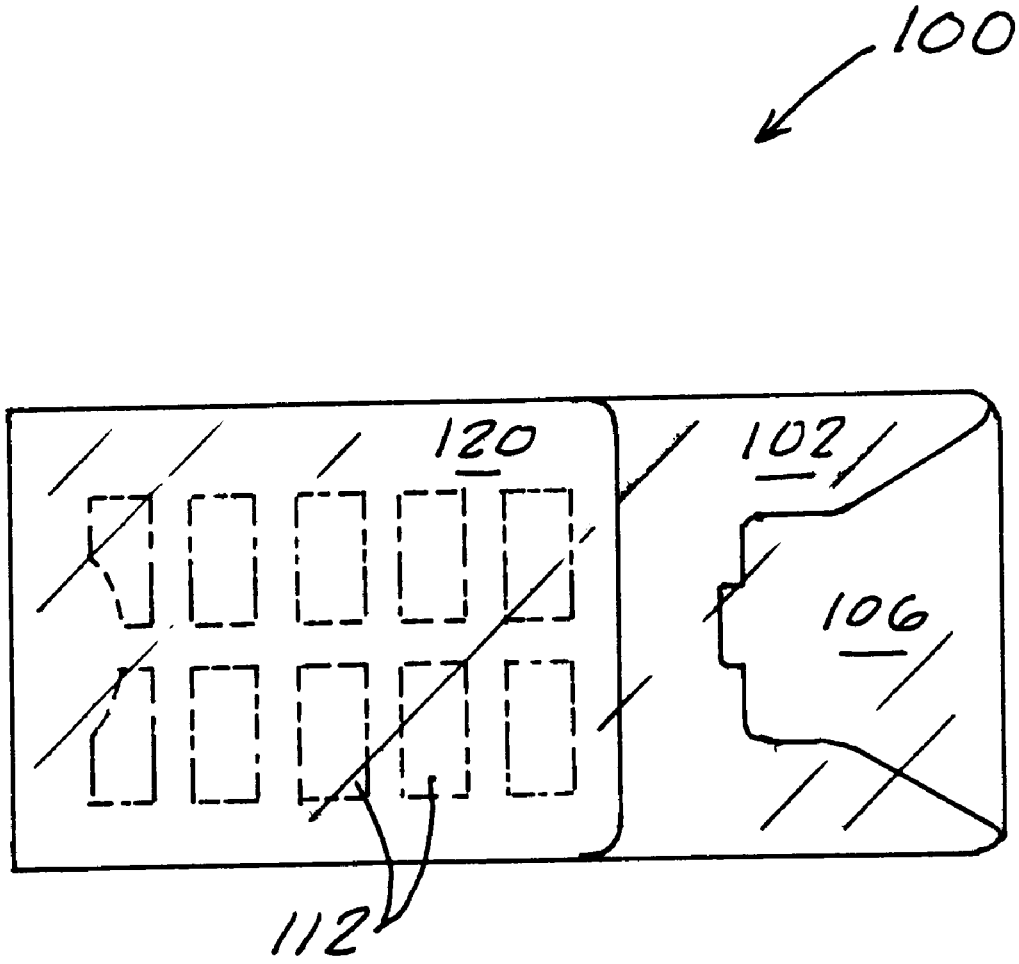
FIG. 9 is a plan view of the inner slide card blank of FIG. 8 with one of the panels folded, according to the present invention.
Figure 10:
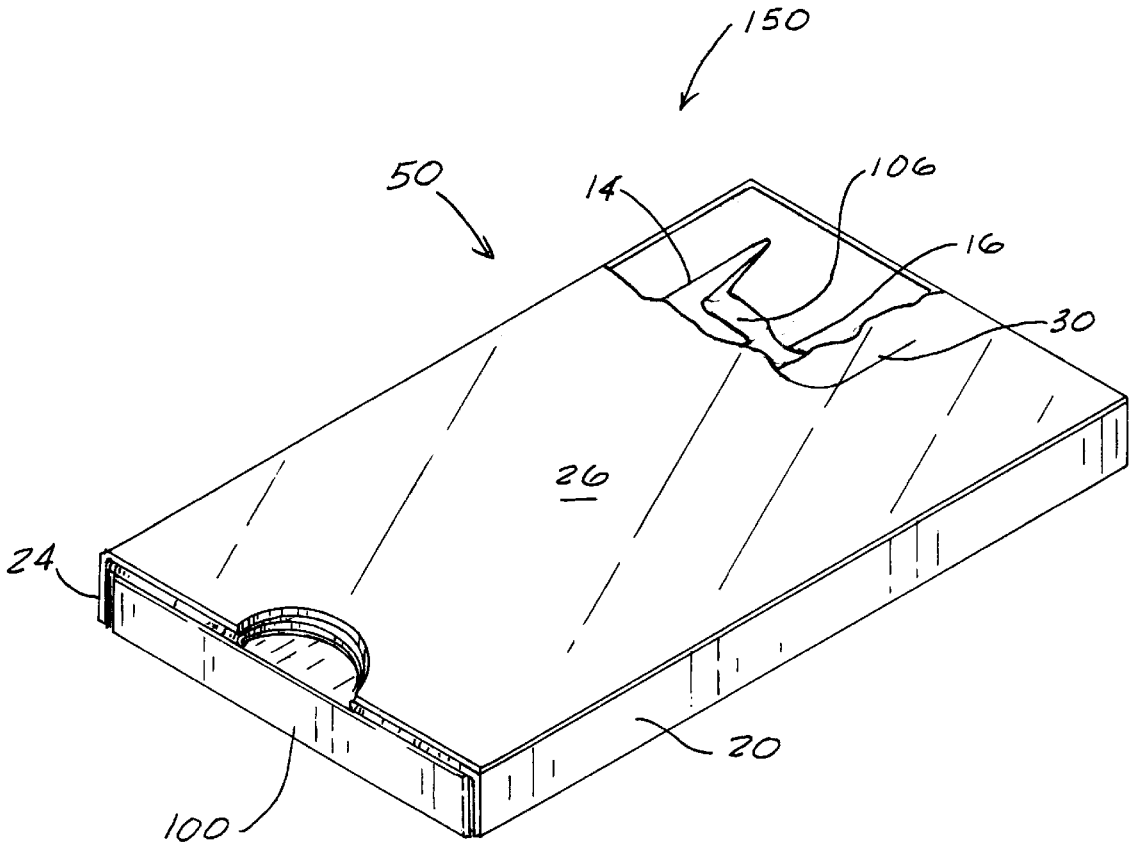
FIG. 10 is an isometric view of a completely constructed unit dose package with the inner slide card located within the outer sleeve and a tear-away section of package showing the locking feature, according to the present invention.

As shown in FIG. 9, side panel 118 is folded over side panel 102 along panel 114 to complete the structure of inner slide card 100.

As shown in FIG. 10, inner slide card 100 is located within outer sleeve 50.

Package 150 also includes a locking feature, as previously discussed. The locking feature consists of release button 30, cut away 14, node 16 and extension panels 6 and 8. In this manner, after inner slide card 100 is placed within outer sleeve 50, extension 106 of inner sleeve 100, extends past opening 14 of outer sleeve 50 as shown in FIG. 10. Once extension 106 is moved past opening 114, extension 106 springs up and enters into opening 14 and is biased against node 16. Therefore, if the end user attempts to remove inner slide card 100 from outer sleeve 50, extension 106 slides up along opening 14 to prevent the removal of inner slide card 100 from outer sleeve 50. However, in order to deactivate the sliding movement of extension 106 along opening 14, the end user merely has to push release button 30 such that extension 106 is pushed against node 16 and below opening 14, thereby preventing extension 106 from sliding up through opening 14.

Figure 11:
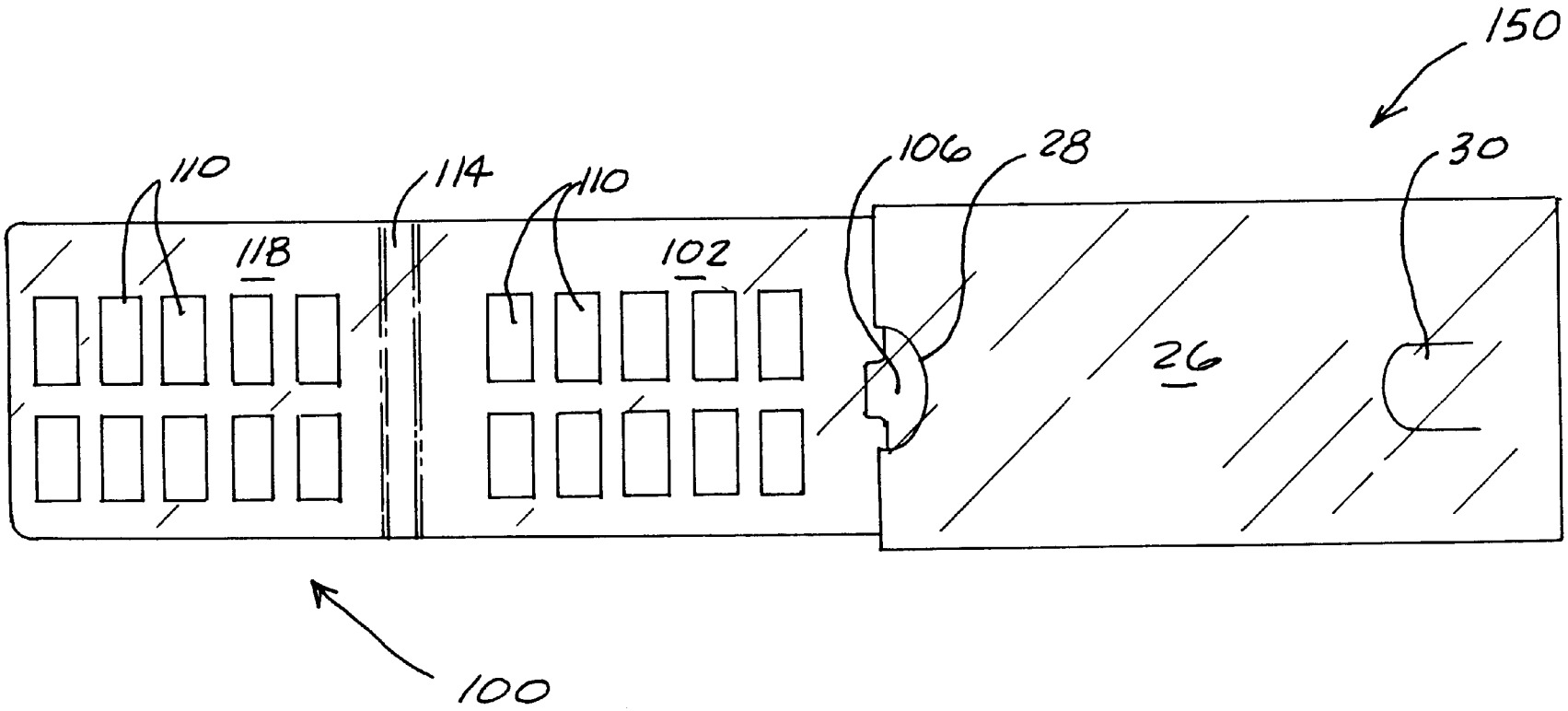
FIG. 11 is a plan view of the inner slide care being pulled out, but lockably retained within the outer sleeve of the unit dose package, according to the present invention.

Finally, FIG. 11 shows the retaining feature of package 150. After release button 30 has been pushed in order to allow the end user to pull inner slide card 100 from outer sleeve 50, extension 106 interacts with the upper end of sleeve 50 near cut away 28 such that extension 106 is caught and retained by folded over extensions 4 and 8 as shown in FIG. 5.

It is to be understood that the purpose of outer sleeve 50 is to house inner slide card 100. In addition, outer sleeve 50 has one or more release buttons 30 to release extension 106 from opening 14. Also, outer sleeve 50 can be formed using a number of conventional techniques that are standard to the folding carton industry. Finally, package 150 can be sealed by conventional techniques to simulate a tamper evident like presence.

It is also to be understood that the purpose of inner slide card 100 is to retain unit dose packaging within outer shell 50. Inner slide card 100 allows the end user to gain access to the unit dose product 122 while pulling inner slide card 100 out until it stops, as shown in FIG. 11. Folded extensions 4 and 8 are used for two functions in the present invention. First, folded extensions 4 and 8 and extension 106 prevent slide card 100 from being completely removed outer shell 50. The second function is that extension 106 serves as a locking mechanism when the package 150 is in the closed position, as shown in FIG. 10.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A unit dose paperboard package having a locking feature, wherein said package is comprised of:

an outer paperboard sleeve and an inner paperboard slide card lockably retained within said outer sleeve, such that said outer sleeve includes a plurality of side panels operatively connected to each other such that one of said plurality of side panels includes an inner slide card retaining means and a first inner slide card releasing means and another of said plurality of side panels includes a second inner slide card releasing means; and said inner slide card includes a plurality of unit dose dispensing means and an inner slide card retaining/releasing means located substantially adjacent to said unit dose dispensing means.

2. The package, as in claim 1, wherein said inner slide card retaining means is further comprised of:

at least one side panel extension hingedly attached to one of said plurality of side panels.

3. The package, as in claim 1, wherein said first inner slide card releasing means is further comprised of:

a cut-out; and a node located substantially adjacent to said cutout.

4. The package, as in claim 1, wherein said second inner slide card releasing means is further comprised of:

a release button.

5. The package, as in claim 1, wherein said inner slide card retaining/releasing means is further comprised of:

a panel extension.

6. An outer paperboard sleeve blank for a unit dose paperboard package, wherein said blank is further comprised of:

a plurality of side panels operatively connected to each other such that one of said plurality of side panels includes an inner slide card retainer and a first inner slide card release, wherein said first inner slide card release is further comprised of: a cut-out; and a node located substantially adjacent to said cut-out; and another of said plurality of side panels includes a second inner slide card release, wherein said second inner slide card release is further comprised of a release button.

* * * * *

UNITED STATES PATENT AND TRADEMARK OFFICE

CERTIFICATE OF CORRECTION

PATENT NO. : 6,047,829

DATED : Apr. 11, 2000

INVENTOR(S) : Scott Bowen Johnstone, Brad Allen Jones, Mark Mellon, and William Roger Rigby It is certified that error appears in the above-indentified patent and that said Letters Patent is hereby corrected as shown below:

Column 5, line 6 (Claim 3, line 4), "cutout" should be --cut-out--.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*